US009909278B2

(12) United States Patent
Morton et al.

(10) Patent No.: US 9,909,278 B2
(45) Date of Patent: Mar. 6, 2018

(54) CONCRETE WALL STABILIZING APPARATUS AND METHOD

(71) Applicant: Nationwide Reinforcing, Ltd., Columbus, OH (US)

(72) Inventors: Steven E. Morton, Pickerington, OH (US); Robert R. Thompson, Columbus, OH (US)

(73) Assignee: Nationwide Reinforcing, Ltd., Columbus, OH (US)

( * ) Notice: Subject to any disclaimer, the term of this patent is extended or adjusted under 35 U.S.C. 154(b) by 0 days.

(21) Appl. No.: 15/054,638

(22) Filed: Feb. 26, 2016

(65) Prior Publication Data

US 2017/0247881 A1 Aug. 31, 2017

(51) Int. Cl.

| | |
|---|---|
| ***E02D 31/10*** | (2006.01) |
| ***E04B 2/24*** | (2006.01) |
| ***E04B 2/02*** | (2006.01) |
| ***E04B 1/00*** | (2006.01) |
| *E04G 23/02* | (2006.01) |

(52) U.S. Cl.

CPC ..... *E02D 31/10* (2013.01); *E04B 1/0007* (2013.01); *E04B 2/02* (2013.01); *E04B 2/24* (2013.01); *E04B 2002/0202* (2013.01); *E04G 23/0218* (2013.01)

(58) Field of Classification Search

CPC ..... E04G 23/0218; E04G 23/0285; E04G 23/0288; E02D 37/00; E02D 31/10; E04B 2/24

USPC ..... 52/127.1, 127.2, 127.5, 289, 291, 293.1, 52/293.2, 293.3, 573.1, 167.1, 167.3, 52/167.4, 514

See application file for complete search history.

(56) References Cited

U.S. PATENT DOCUMENTS

| | | | | | |
|---|---|---|---|---|---|
| 1,019,778 | A | * | 3/1912 | Fredrickson | E04B 1/2604 248/218.4 |
| 1,785,791 | A | * | 12/1930 | Ropp | E04B 1/2612 52/702 |
| 2,321,221 | A | | 6/1943 | Linehan | |
| 2,850,254 | A | | 9/1958 | Houseworth | |
| 3,365,222 | A | | 1/1968 | Polyak | |
| 3,537,220 | A | | 11/1970 | Ellis | |
| 3,633,950 | A | * | 1/1972 | Gilb | E04B 1/2608 403/384 |
| 4,202,149 | A | * | 5/1980 | Betrue, Sr. | E04B 1/0007 52/293.3 |

(Continued)

*Primary Examiner* — Rodney Mintz

(74) *Attorney, Agent, or Firm* — Jason H. Foster; Kremblas & Foster

(57) ABSTRACT

Concrete wall supports that reduce or eliminate wall movement due to exterior horizontal forces. One support is a bracket mounted to a floor joist with a plate extending below the top of the wall and two legs extending from the plate and attaching to the joist. One leg is above the concrete wall on one horizontal side of the plate, and the other leg is on the opposite side of the plate. Another support has a plate that extends below the top of the wall with two legs on opposite sides of the joist above the wall. A leg attaches to the lower edge of the joist. A support against shear forces includes a highly water permeable aggregate composite disposed in the voids of the wall, with a supportive strip that is enclosed in the aggregate composite and extends out of the voids to the face of the wall.

5 Claims, 9 Drawing Sheets

(56) References Cited

U.S. PATENT DOCUMENTS 4,330,971 A * 5/1982 Auberger ..... E06B 1/6092 403/232.1
4,414,785 A * 11/1983 Howell ..... E04B 1/2612 403/191
4,763,878 A 8/1988 Abraham et al.
5,845,450 A 12/1998 Larsen
6,036,165 A 3/2000 Lee
6,047,504 A * 4/2000 Dusenberry ..... E04B 7/045 52/514
6,357,190 B1 3/2002 Florentine
6,662,505 B2 12/2003 Heady et al.
6,662,517 B1 * 12/2003 Thompson ..... E04H 9/14 52/712
6,817,157 B2 11/2004 Bourque
7,380,372 B2 6/2008 Resch et al.
7,419,335 B1 9/2008 Cohen
7,681,367 B2 3/2010 Morton et al.
7,774,995 B1 8/2010 Zidar, Jr.
8,136,317 B1 3/2012 McCown
8,910,452 B2 * 12/2014 Noturno ..... E04B 1/2608 52/712
2004/0244328 A1 * 12/2004 Bak ..... E04B 1/2612 52/712
2006/0016138 A1 * 1/2006 Blount ..... E04B 5/40 52/263
2007/0234662 A1 * 10/2007 Hanig ..... E04H 7/30 52/293.3
2009/0071085 A1 * 3/2009 Wheatley ..... E04G 23/0218 52/291
2012/0180412 A1 * 7/2012 Secrest ..... E02D 29/00 52/222
2013/0067839 A1 * 3/2013 Zimmerman ..... E04B 1/26 52/293.3
2013/0232895 A1 * 9/2013 Berset ..... E04G 23/0218 52/223.8
2013/0247485 A1 * 9/2013 Zimmerman ..... E02D 27/00 52/167.1
2014/0137485 A1 * 5/2014 Lafferty, III ..... E06B 9/04 52/29

* cited by examiner

CONCRETE WALL STABILIZING APPARATUS AND METHOD

BACKGROUND OF THE INVENTION

The invention relates generally to the field of concrete wall stabilization, and more particularly to structures mounted to concrete walls to prevent or mitigate inward movement due to external forces.

It is known in the field of construction and repair of homes and other buildings that basement walls are typically made of concrete. The concrete can be poured as solid walls, or individual concrete blocks can be stacked with mortar placed therebetween to form a wall. Concrete block walls are commonly hollow, but can be filled with concrete and reinforcing rods of metal or other material in order to strengthen the walls and make them less susceptible to the infiltration of water.

Concrete walls of all types are extremely strong in compression, and have disproportionate weakness in tension and shear. This causes concrete walls subjected to substantial tensile and/or shear forces to fracture. A common source of tensile and shear forces in basement walls is a horizontally-directed inward force applied to the walls by the soil that is backfilled against the subterranean walls. This results in a bending force on the walls, which creates a tensile force on the inside of the wall, and causes walls to crack once the force becomes sufficient. Additionally, such inwardly-directed forces can move rows of blocks, or the entire wall, inward in shear from the foundation rather than, or in addition to, causing bowing. This has an obvious deleterious effect on the structural integrity of the building, and can allow water infiltration.

Reduction in horizontal forces can alleviate the bowing of basement walls, and this can be accomplished by reducing water flow into the soil surrounding the building and other methods. Additionally, or alternatively, the walls themselves can be strengthened in order to alleviate bowing and or shearing. Historically, the strengthening of subterranean walls has been accomplished by placing a structural member against the interior surface and bracing that member against other structural members of the building, such as the concrete floor at the base of the bowed wall, and the floor joists at the top of the bowed wall. This can be carried out using simple fasteners, or more complex jacks.

U.S. Pat. No. 6,662,505 to Heady et al., which is incorporated herein by reference, discloses an apparatus for applying a horizontal force at the top of a structural member, such as a steel I-beam. The beam is mounted to the basement floor at its base, and the top is mounted in the apparatus of Heady. Upon the application of force to the top of the beam by screwing in the threaded bolt of Heady's device, the beam is forced against the bowed wall, and exerts a force to the wall that opposes the bowing force.

One disadvantage of the Heady patent and most other conventional wall reinforcement methods of which the inventors are aware is that they do not supply a force against the wall that remains if the soil contracts and the wall moves outward toward the soil. The only alternative in the prior art is to check the force on the beam frequently and manually tighten the screw that applies the force.

U.S. Pat. No. 7,681,367 to the present inventors, which is incorporated herein by reference, addresses the problem of the variations in forces. However, there is a need for other structures that apply a force to a basement or other concrete wall, or at least stop movement of the wall by external forces, along with a means and/or method of preventing or mitigating lower block shear.

BRIEF SUMMARY OF THE INVENTION

Disclosed herein is a V-shaped support bracket with two legs that have a small plate at the deepest part of the V. The legs of the V are fastened to a floor joist that rests on a sill plate that rests on a concrete wall. The plate extends downwardly to inside the inwardly-facing surface of the concrete wall to resist the inward forces caused by hydrostatic pressure. When a horizontal, inwardly-directed force is applied to the small plate, the support bracket, and, thereby, the joist is forced horizontally away from the wall, which the joist resists due to the opposite basement wall and the weight of the house. Further, there are different components of force on the joist due to the moment arm formed by the legs and the plate. The leg extending toward the outside of the wall is in tension, and the leg extending inside of the building is in compression. The moment arm causes a rotational force to be applied to the joist, tending to force the joist end downward onto the concrete wall, and this increases the friction that resists inward movement of the joist beyond the friction caused by the weight of the house bearing down on the joist. Thus, the greater the inwardly-directed force of the wall against the small plate, the greater the downward force tending to resist movement of the joist relative to the wall.

Also disclosed herein is a support that has two legs that extend from a plate that seats against the wall in an operable position. A joist-mounting plate extends away from the plate substantially perpendicularly. One end of the joist-mounting plate is positioned between the legs. Apertures are formed in the joist-mounting plate and in the legs. In the preferred mounting location for the support, the joist-mounting plate rests against the lower edge of a joist, and the legs extend upwardly on opposite sides of the lower edge of the joist. Screws, nails or any other fasteners extend through the apertures formed in the joist-mounting plate to fix the support to the joist. The aligned apertures formed in each of the legs preferably receive screws or bolts that are tightened against the legs, and extend through holes formed in the joist. Thus, any inwardly directed movement by the wall is resisted by the abutting support, which transfers the inwardly-directed load to the joist.

Further disclosed herein is a wall in which material is installed in voids within sections of the wall, such as between a first and second course of blocks. When hardened, the material resists inward movement of the wall, and specifically the sections of the wall, such as the second course of blocks relative to the first course. An aggregate composite is deposited within voids conventionally formed in at least about the lowest two courses of blocks, and may be deposited within voids in any portion of the wall. The aggregate composite is highly water-permeable, thereby allowing water to readily flow through the composite. This permits water that enters the wall voids to flow downwardly and out of the wall while still resisting shear movement of the wall relative to the first or any other course of blocks that are supported against inwardly-directed movement by the floor slab.

In addition to the aggregate composite, a strip may be placed into the voids of the blocks. The strip may be placed in the voids prior to placing the composite in the voids. The strip is preferably inserted into the blocks until an upwardly-extending leg is placed against the inwardly-facing surface of the wall, and a downwardly-extending leg is disposed within the void in the lowest of the two lower courses of blocks. Alternatively, the strip may be a continuation of a composite adhered to the face of the wall, and further may have a rod extending therethrough or around which the composite is wrapped. As the aggregate composite is placed in the void, the composite flows downwardly and around the strip and fills the void between the downwardly-extending leg and the inside of the front face of the block. Upon hardening, the aggregate composite immobilizes the strip in the void by surrounding the strip and extending to the limits of the void's defining sidewalls. Thus, any force applied to the strip tending to move the strip horizontally inwardly, outwardly or in any other direction, is resisted by the hardened composite.

Figure 1:
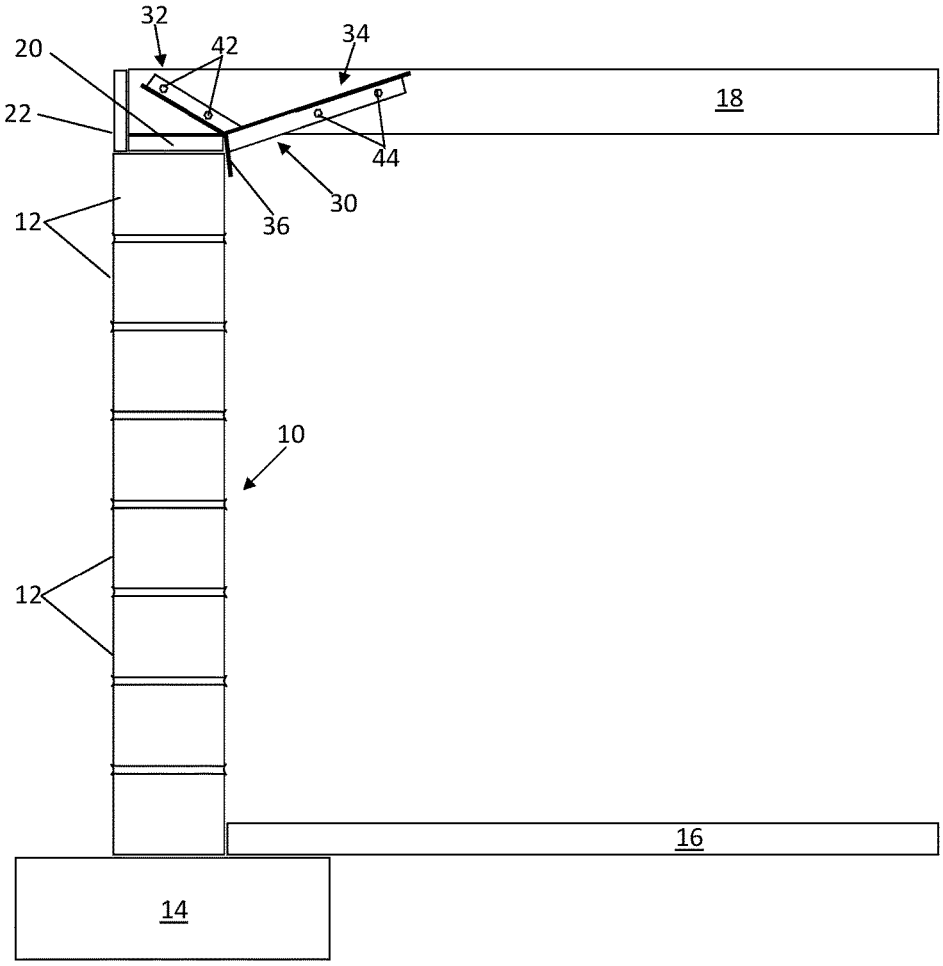
FIG. 1 is a schematic side view illustrating a concrete wall in combination with an embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Pat. No. 7,681,367 is incorporated in this application by reference.

In FIG. 1 a concrete wall 10 is shown that is formed of a plurality of concrete blocks 12 that are preferably fastened together with conventional mortar between adjacent blocks. The stack of blocks 12 rests upon a footing 14, which is conventional for buildings in order to provide a stable foundation on which to support the weight of the building. The footing 14 is preferably formed conventionally of hardened concrete that was poured in a semi-liquid state into a trench dug around the base of the building site. A slab 16, which is conventionally made of concrete that was poured in a semi-liquid state onto a gravel bed placed inside the footing. The slab 16 rests upon the footing 14 and the gravel, and abuts the lowest block 12 at the periphery of the slab 16. A conventional floor joist 18 rests at its outer edges on a conventional sill plate 20 that is fastened to the top of the wall 10 in a conventional manner. A band board 22 is fastened to the ends of the joist 18, the parallel joists, and the sill plate in a conventional manner.

Figure 2:
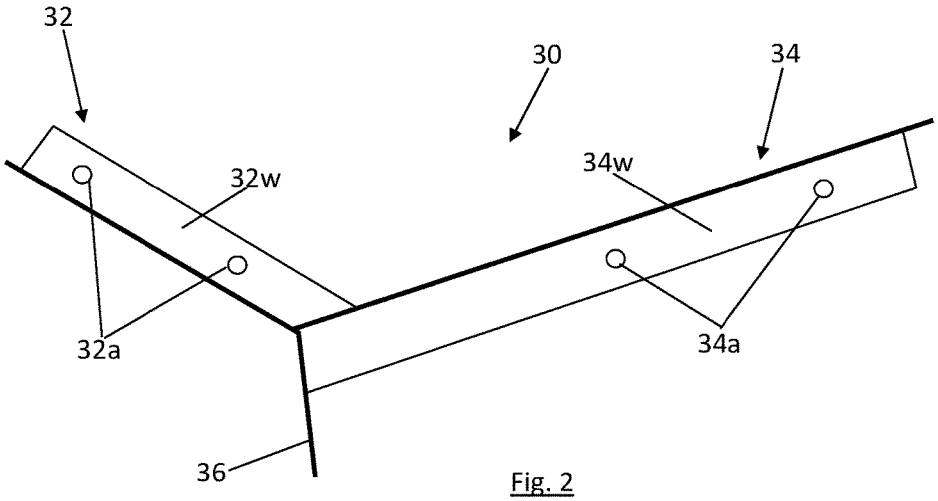
FIG. 2 is a side view illustrating an embodiment of the present invention.
Figure 3:
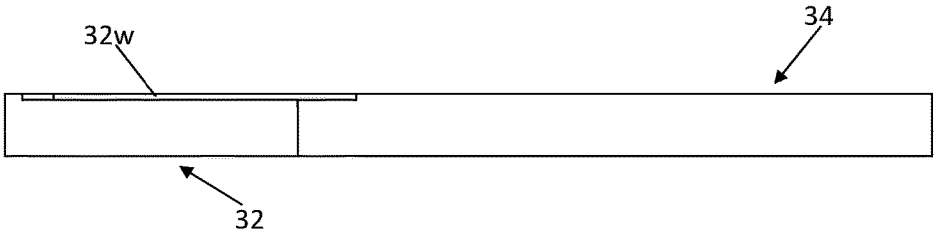
FIG. 3 is a top view illustrating the embodiment of FIG. 2.
Figure 4:
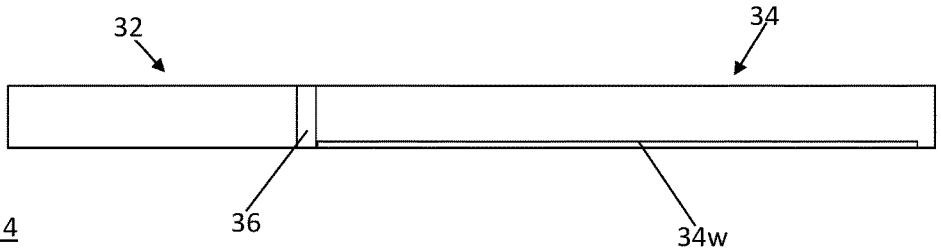
FIG. 4 is a bottom view illustrating the embodiment of FIG. 2.

As shown in FIG. 1, a support bracket 30 is mounted near the end of the joist 18. The support 30 is shown by itself in more detail in FIG. 2, and may be made of steel, aluminum, titanium, fiber-reinforced plastic or any other strong material. The support 30 has an outer leg 32 and an inner leg 34, which form two legs of a generally V-shaped structure. A plate 36 extends downwardly (in the orientation shown in FIG. 2) from the intersection of the inner and outer legs, and the legs attach to the upper end of the plate 36. The inner leg 34 has a web 34*w* that extends downwardly in the FIG. 2 orientation, and the outer leg 32 has a web 32*w* that extends upwardly in the FIG. 2 orientation. Apertures 32*a* and 34*a* are formed through the webs 32*w* and 34*w*, respectively.

The support 30 is shown in FIG. 1 having fasteners, such as screws 42 and 44, extending through the apertures 32*a* and 34*a* and into the joist 18. The screws 42 and 44 can be replaced by any conventional suitable fastener including, without limitation, bolts, rivets, nails and adhesives. Thus, the support 30 is firmly mounted to the joist 18 with the plate 36 extending downwardly to below the sill plate 20 and the plate 36 is disposed horizontally inwardly from the top edge of the concrete wall 10. The plate 36 preferably touches the inner surface of the wall 10. If the plate 36 is not in contact with the wall 10, it is at least in close proximity to the wall, which means the plate 36 is a distance that, if the wall 10 moves that distance before abutting the plate 36 this is a distance that does not permit substantial damage to the wall. This distance may be a few millimeters. In a preferred embodiment, the plate 36 extends downwardly one to three inches below the top edge of the wall 10, but it is sufficient for the plate 36 to extend about one inch below the top edge of the wall 10.

When in an operable position shown in FIG. 1, the legs 32 and 34 extend toward opposite ends of the joist 18 from the plate 36. The legs 32 and 34 preferably form a V-shape with each of the legs 32 and 34 extending vertically upwardly and horizontally in opposite directions from the upper end of the plate 36. The inner leg 34 extends horizontally toward one end of the joist 18 and the outer leg 32 extends horizontally toward the opposite end of the joist 18 and is disposed above the wall 10.

The positions of the legs 32 and 34 relative to the plate 36 form a moment arm that receives any inwardly-directed, horizontal forces that the wall 10 applies to the plate 36. Such horizontal forces may be caused by hydrostatic or other forces directed against the outer surface of the wall 10. The inwardly-directed forces that the wall applies to the plate 36 compress the inner leg 34 and pull the outer leg 32 in tension. The plate 36 is oriented substantially perpendicular to the horizontally-directed force, and is spaced vertically from the screws 42 and 44, and this configuration forms a moment arm that applies a net rotational force to the joist 18, in addition to compressing the joist along its length. This rotational force created by the length of the plate 36 extending downwardly from the screws 42 and 44 causes a downward force on the end of the joist 18 at the screws 42, which is the end that rests upon the sill plate 20, and an upward force on the portion of the joist 18 at the screws 44. This downward force on the sill plate 20 increases the frictional resistance to movement between the joist 18 and the sill plate 20, and between the sill plate 20 and the wall 10.

The structural configuration of the support 30 results in a "truss" effect where the outer leg 32 and the inner leg 34 mount to the joist 18. The portion of the joist 18 between the screws 42 and 44 serves as the third side of a triangular "truss" member. The truss is thus formed by the two legs 32 and 34 having an angle between them of less than 180 degrees so that the portion of the joist 18 between the screws 42 and 44 may serve as the third side of a triangle. The angle between the legs 32 and 34 may be 60 degrees, 90 degrees, 120 degrees, or any angle less than 180 degrees. This proves to be an extremely strong support that is advantageous because the moment arm formed by the plate 36 creates a substantial force, which would distort a support in which the legs were along a line. Instead, because the tensile force applied to the outer leg 32 and the compression force applied to the inner leg 34 are also supported by the portion of the joist 18 that extends between the screws 42 and 44, a very strong, triangular member is formed by the support 30 mounted to the joist 18 as shown and described. This triangular member avoids torsional forces at the connections (screws 42 and 44) between the members of the triangle, and instead there are essentially only compression and tensile forces along the legs and in the joist segment between the screws 42 and 44.

With the support 30, the inwardly-directed, horizontal forces of the wall 10 are transferred to the joist 18 where a support 30 and any similar supports are mounted along the wall 10 to a parallel joist. It is contemplated that supports substantially similar to the support 30 may be mounted to every joist along a wall that is at risk of, or has shown signs of, being pushed inwardly. Thus, supports like the support 30 may be mounted to two or more adjacent joists along the same wall. Such a configuration is likely to greatly reduce any horizontal inward movement of the top of the wall. The bottom of the wall 10 may also move, however, and the following structure is devised to halt or reduce such movement, either alone or in combination with an upper wall support like the support 30.

Figure 5:
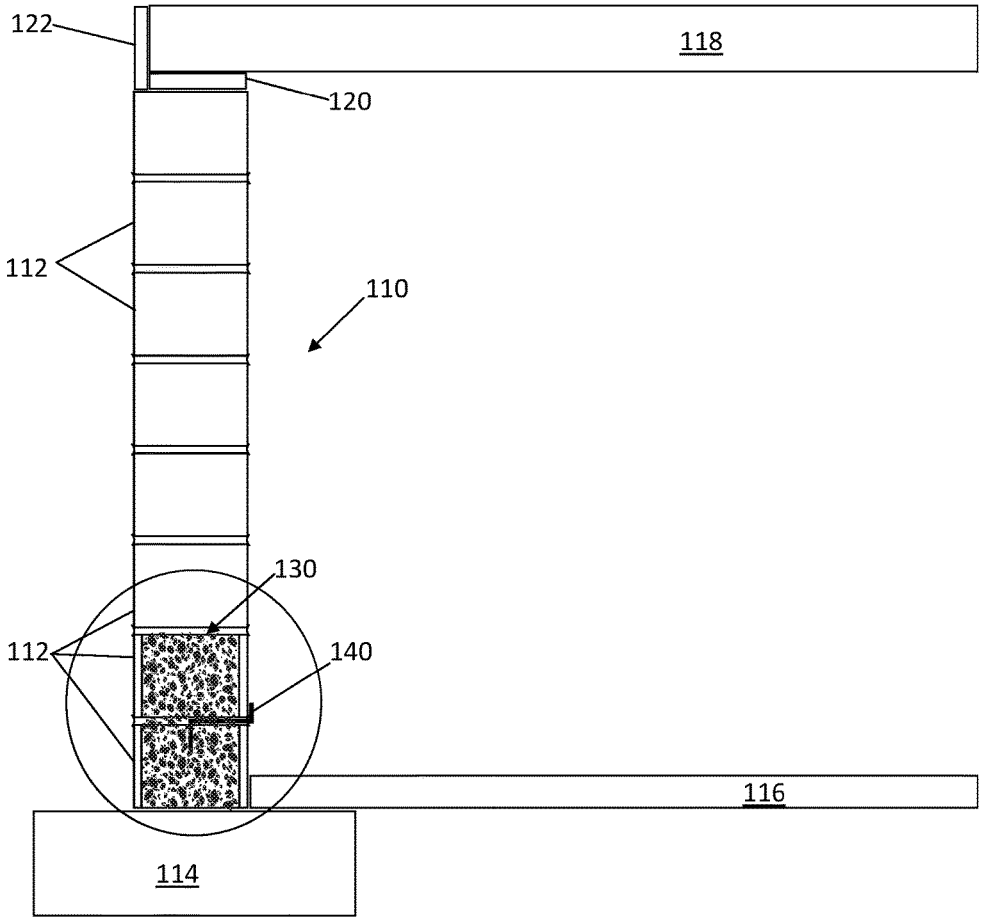
FIG. 5 is a schematic side view in section illustrating a concrete wall in combination with an embodiment of the present invention.

In FIG. 5 a concrete wall 110 is formed of a plurality of concrete blocks 112 that are preferably fastened together using conventional mortar between adjacent blocks, as with the wall 10 described above. The stack of blocks 112 rests upon a conventional footing 114 that is preferably formed of hardened concrete. A slab 116, which is conventional concrete poured onto a gravel bed that is placed inside the footing, rests upon the footing 114 and the gravel, and abuts the lowest block 112 at the periphery of the slab 116. A conventional floor joist 118 rests at its outer edges on a sill plate 120 that is fastened to the top of the wall 110. A band board 122 is fastened to the ends of the joists and the sill plate in a conventional manner.

As is well known, the lower end (first course) of concrete wall blocks 112 rests upon the footer 114, and the concrete slab 116 seats directly against the sides of the first course of blocks 112. The second course of blocks 112 is directly above the first course, and this second course has a substantial tendency to be driven inwardly by hydrostatic pressure because it is deep in the ground, but it does not have the slab 116 to help resist inward movement. Thus, it is not uncommon in conventional concrete block walls to see inward movement of the second course of blocks relative to the first course when no steps have been taken to prevent this. Of course, any course of blocks in the wall may move inwardly relative to the first, or next lower, course, and the solution described herein to mitigate movement of the upper course may be applied to any course of blocks relative to any lower course of blocks.

It is contemplated to install a material into the voids **112*v* within the courses of blocks of interest, which may be the first and second courses of blocks, and that material, when hardened, resists this movement, but does not have the deleterious effects of conventional materials used to fill hollow blocks. Within the voids 112*v* conventionally formed in at least about the lowest two courses of blocks 112 (the voids are illustrated in only the lower two courses of blocks in the schematic illustration of FIG. 5 but may exist in other, or all, blocks 112), an aggregate composite 130 is deposited. The aggregate composite 130 is preferably placed in the voids formed in conventional hollow cement blocks when the mixture is in a fluent state, such as when a liquid, paste or semi-liquid adhesive coats each of the particles in the aggregate composite 130 prior to hardening. This fluent mixture can be formed by placing particulate, such as stones, and an adhesive in a conventional rotating drum mixer, which is commonly referred to as a "cement mixer" and mixing until all particles are coated with the adhesive described below. The mixture may then be poured into an opening formed through the mortar joints above the second course of blocks 112**. Openings about three inches wide by about one inch tall can be formed in the mortar joints to gain access to the voids, and the mixture may be poured through the mortar joints into the voids using funnels, flat guides or any other suitable means. Tools can be extended into the voids to compress the mixture, or the wall can be vibrated mechanically to encourage settlement of the mixture. Upon hardening, which typically happens within a matter of hours, the mixture attains a very strong configuration, with shear and compression strength equal to, or greater than, concrete. The mortar joints are then repaired.

One example of an aggregate composite is number eight stone (e.g., crushed limestone or other stone pieces that have a size from about three-eighths inch to about one-half inch) that is liberally coated with an adhesive. Any particles to which a binding agent will adhere may be used in an aggregate composite, and the particles contemplated are not limited to stones, or to stones of the above-noted size. A thermosetting epoxy, such as polyurethane, is contemplated as the adhesive, but porous cement, any suitable polymer such as polyester, or any other binding agent known to adhere particulate together could be substituted for the epoxy. Any adhesive applied to the particulate (e.g., stone) is supplied in liquid form in an amount relative to the surface area of the stones and the viscosity of the liquid that is sufficient to coat all stones, but not fill the interstices between adjacent, contacting stones after the stones are placed in the voids of the wall 110 and settle or are compacted. The stone can be limestone or any other particulate that has strength sufficient to resist fracture when coated with an adhesive that adheres the particles together at contacting points, and when a force is exerted against the blocks 112 that tends to cause horizontal movement of a first block relative to another block above the first block. By coating the stones with the adhesive but not filling the interstices with the adhesive, there is sufficient adhesion at contact points between the stones to resist fracture of the hardened structure, but the interstices are left open to permit water to flow through. The particulate in the hardened composite has sufficient adhesive for each particle to adhere to any contacting particles, but not so much that all interstices between the adjacent particles are filled to the point of preventing water from flowing through the resulting aggregate.

The aggregate composite 130 is thus highly water-permeable, meaning water can readily flow from the top of the composite 130 to the bottom of the composite 130 and out all sides thereof (without any structure blocking the sides). This highly water-permeable structure permits water that enters the wall voids 112*v* due to cracks, pressure or any other means to flow downwardly toward the footing 114. Thus, such water can flow out of any weep-holes that are formed around the foundation of the wall 110 and/or into any conventional drains that are commonly placed around footings.

In addition to the aggregate composite 130, a strip 140 may be placed into the voids of the blocks 112. At the lower end of the wall 110, the rigid strip 140, which may be made of steel, aluminum, titanium, fiber-reinforced plastic or any other strong material, is inserted between the lowest block 112 and the next lowest block 112. The strip 140 may be placed in the voids prior to placing the composite 130 in the voids, or at least prior to the composite 130 hardening.

Figure 7:
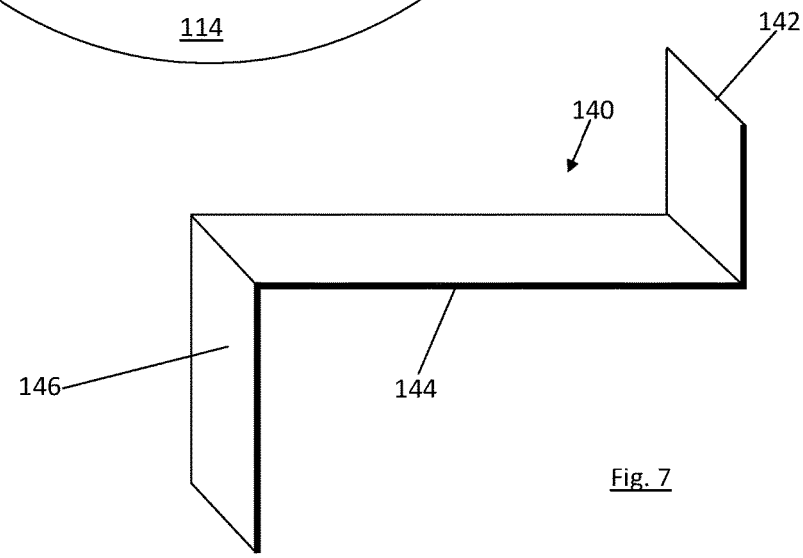
FIG. 7 is a view in perspective illustrating an embodiment of the present invention.

The strip 140, which is shown in great detail in FIG. 7, has an upwardly-extending leg 142 and a downwardly extending leg 146 connected by a horizontal leg 144. The orientation of the strip 140 is not limited by the terminology used for its components (e.g., upwardly, downwardly and horizontal), but these terms are used herein for the orientation shown in FIG. 5.

Figure 6:
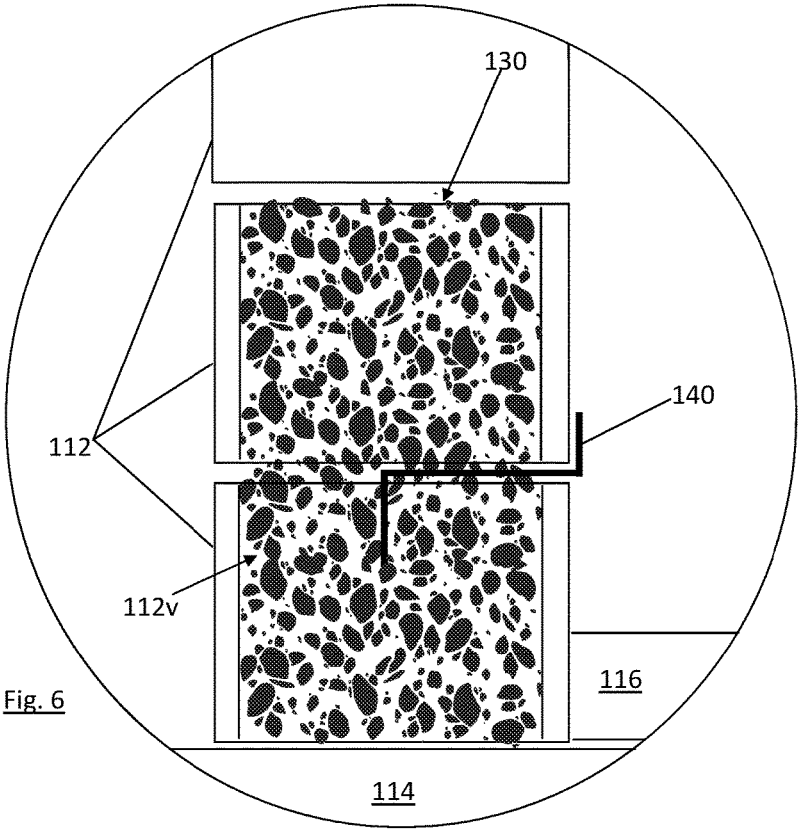
FIG. 6 is a side view in section illustrating the encircled portion of FIG. 5 in greater magnification.

The strip 140 is preferably inserted into the blocks 112 through an opening formed in the mortar between the courses of blocks 112 between the upper and the lower of the two lowest blocks 112. The opening need be only slightly larger than the width and thickness of the strip 140 so that the downwardly-extending leg 146 can be inserted therethrough until the horizontal leg 144 reaches the opening. The strip 140 is further inserted until the upwardly-extending leg 142 is placed against the inwardly-facing surface of the wall 110 as shown in FIGS. 5 and 6, and the downwardly-extending leg 146 is disposed within the void 112*v* in the lowest of the two lower courses of blocks 112.

As the aggregate composite 130 is placed in the void 112*v*, the composite flows downwardly and around the strip 140 and fills the void 112*v* as full as is feasible, which includes flowing between the downwardly-extending leg 146 and the inside of the front face of the block 112. The aggregate composite thus flows into the voids around the strip 140 wherever the particles fall, and there is preferably even better flow than with dry stone due to the lubricant effect the liquid adhesive has on the flow of the particles. Thus, the space between the downwardly-extending leg 146 and the front face of the block 112 is filled with aggregate composite 130.

Upon hardening, the aggregate composite 130 forms a very strong filler of the void 112*v* and immobilizes the strip 140 in the void 112*v* by surrounding the strip 140 and extending to the limits of the void's defining sidewalls. Thus, any force applied to the strip 140 tending to move the strip 140 horizontally inwardly, outwardly or in any other direction, is resisted by the hardened composite 130, which is resisted by the sidewalls of the respective block(s) 112, and adhesion to the walls of the blocks 112 within the voids 112*v*. In a preferred embodiment, the composite 130 fills the voids 112*v* above the strip 140 to about the top of the second course of blocks 112 up from the footing 114. Filling with aggregate composite is accomplished by drilling or otherwise removing the mortar in the gap between courses of blocks and pouring in the fluent, adhesive-coated particulate, as described above. Of course, the amount of composite can be determined by preference, inasmuch as there are diminishing benefits with increased cost associated with the materials and labor to place the composite in the wall 110 to a higher level. Nevertheless, the composite can be filled any amount from just above the strip 140 to the top of the wall 110, or any place in between, and preferably to about the top of the next block above the strip 140. In this way, the strength of the composite is high, the strip is completely surrounded by composite, and the height of the composite is visible (and can thereby be confirmed) through the fill hole formed at the inner face of the mortar joint between the second and third blocks 112 from the footing 114. The strip 140 is shown in FIG. 6 mounted in the void 112*v* and surrounded by the composite 130.

The preferred process of placing the strip 140 in the wall 110 includes forming a gap between the particular courses of blocks at issue, such as the first and second courses of blocks 112. The gap can be formed by drilling, sawing and/or chiseling out the mortar between the first and second courses of blocks. The next step is to place the strip 140 in position in that gap as shown in FIGS. 5 and 6. The next step is to pour adhesive-coated particles into the void where the strip 140 is positioned, such as by forming an opening in the next mortar joint up from where the strip 140 is inserted, and then pouring the fluent particle/adhesive mixture through the hole. The hole may be about three inches wide and about three-quarters of an inch tall. The mixture is poured through the opening in the mortar joint and flows into the voids below it. It may be packed down to remove larger voids between the particles. The adhesive subsequently hardens by curing and/or drying around the strip 140 within the void. Once hardened, the aggregate composite 130 transfers the inwardly-directed force applied to the second course of blocks 112 onto the strip 140, which transfers the force to the aggregate composite 130 inside the first and any other course of blocks, and this transfer halts inwardly-directed movement due to the first course of blocks 112 abutting the slab 116. This may be reinforced with additional, substantially identical strips positioned laterally from the strip 140 and similarly placed between blocks in the first and second courses. Furthermore, if one fills the blocks 112 with the aggregate composite 130 higher than the second course, one can place strips substantially identical to the strip 140 between any of the courses of blocks as far up the wall as is desired. It is contemplated to reverse the order of the steps of placing the strip 140 in position in the gap and pouring adhesive-coated particles into the void where the strip 140 is positioned so that the adhesive-coated particles are first poured into the void and then the strip 140 is positioned in the gap.

It is understood that by transferring the force from the face of the upper (e.g., second) course of blocks to the aggregate composite 130 inside the lower (e.g., first) course of blocks, the force on the aggregate composite 130 is in compression rather than shear. This is a superior reinforcement to when only an aggregate composite mixture is disposed in the voids of the blocks. Furthermore, water can still flow through the aggregate composite 130 to keep the wall 110 as well drained as without the aggregate composite 130.

It is contemplated to fill one to two courses of block with the aggregate composite 130, and this may be sufficient to stop inward movement of all courses of blocks 112. The critical joint where support is needed is between the first course and the second course. More than the first two courses can be filled with composite, but at diminishing benefits of support to the wall, and at increasing cost to install.

The lower block strengthening process and apparatus described above preferably includes two embodiments. The first embodiment is the use of an aggregate with adhesive that leaves openings between the aggregate pieces sufficient in size to allow water to flow freely therethrough. The second embodiment combines the first embodiment with the strip 140, which transfers the force to the front of the face of the second block. The porous aggregate feature may be used alone, or it may be used in combination with the strip 140.

The aggregate composite provides a substantial shear resistance, and therefore the first embodiment may be the only embodiment used in some walls. That is, some walls may be reinforced simply by disposing the aggregate composite with high water permeability in the voids of at least the first and second courses for a predetermined lateral distance along the wall. The strip 140 adds an additional level of reinforcement by using the compressive strength of the aggregate composite and the substantial strength in tension of the strip 140. Furthermore, even if a shear force breaks the bonds of the aggregate composite 130, the strip 140 continues to resist further movement. Because the strip 140 may be made of steel, aluminum, titanium, fiber-reinforced polymer or many other materials, a shear fracture of the aggregate composite does not result in the end of wall reinforcement.

The length of the strip 140 and the depth of the aggregate composite 130 cause the force applied by the strip 140 to be transferred to the width of the lower (e.g., first) course of blocks and a larger height of the first course of blocks than if the strip 140 were applied directly to a block's inner face. Because the strip 140 extends into the middle of the block's void, and because a large amount of aggregate composite 130 is disposed between the downwardly-extending strip 146 and the block's sidewall, a greater portion of the block is used to support the inward force than if the strip 140 seated directly against the block.

It should be noted that the lower block strengthening process and apparatus may be used in a wall alone as shown in FIGS. 5-7, or, alternatively, the lower block strengthening process and apparatus may be used in combination with the support 30 or any other support at the upper end of a wall. Still further, any type of wall stiffening apparatus may be used with either the upper or lower wall strengthening process and apparatus, or both, to reduce the bending in the wall. For example, fiber-reinforced polymer plates (described in U.S. Pat. No. 7,681,367) may be adhered to the wall 10 between the support 30 and the lower block strip 140 that is combined with the aggregate composite inside the wall 110. Alternatively, steel beams may be extended between an upper support and a lower support. In any case, a component of the support 30 and/or any other upper wall support may rest against such a wall-stiffening structure that is adhered to the wall or abuts the wall, and such wall-stiffening structure is considered part of the wall for the purposes of the invention. The same applies to the strip 140 used at the bottom of the wall, and this strip 140 may rest against a steel beam's inwardly-facing surface or the inwardly-facing surface of a fiber-reinforced polymer plate that is adhered to the wall. Thus, such structures that halt and/or reverse wall-bending are considered components of the wall for the purposes of the invention.

Figure 13:
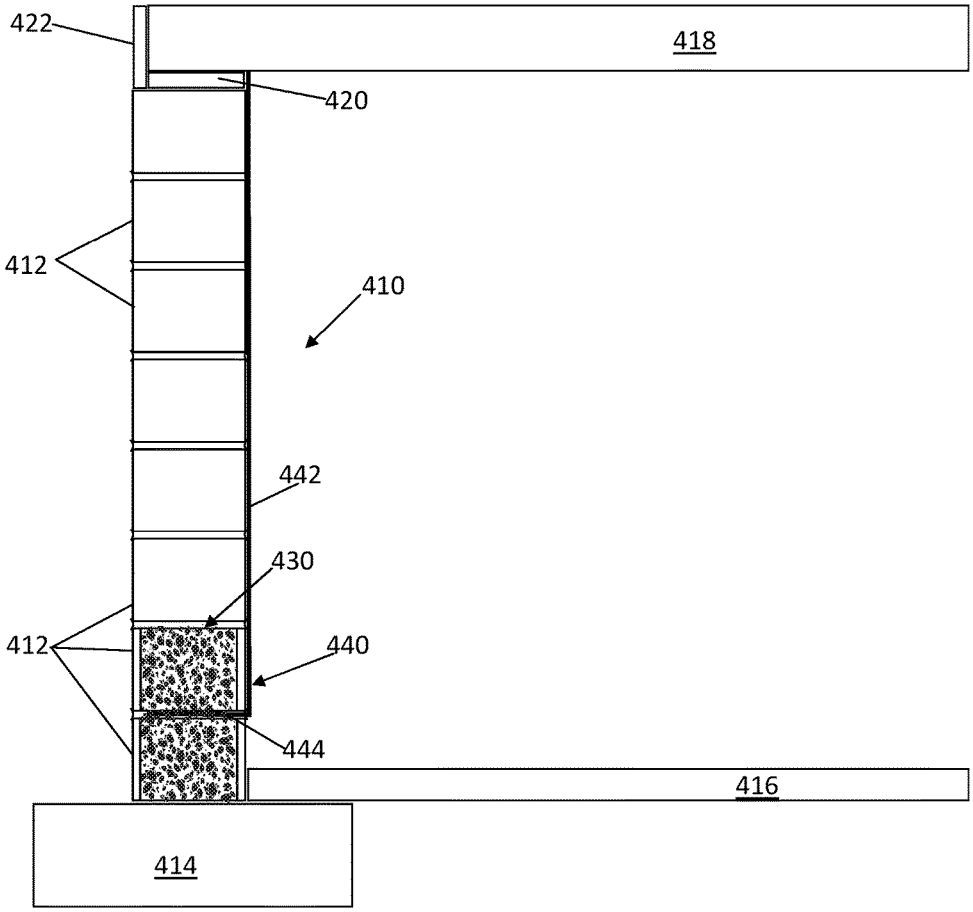
FIG. 13 is a schematic side view in section illustrating a concrete wall in combination with an embodiment of the present invention.

In FIG. 13 a concrete wall 410 is formed of a plurality of concrete blocks 412 that are preferably fastened together using conventional mortar between adjacent blocks, as with the wall 10 described above. The stack of blocks 412 rests upon a conventional footing 414 that is preferably formed of hardened concrete. A slab 416, which is conventional concrete poured onto a gravel bed that is placed inside the footing, rests upon the footing 414 and the gravel, and abuts the lowest block 412 at the periphery of the slab 416. A conventional floor joist 418 rests at its outer edges on a sill plate 420 that is fastened to the top of the wall 410. A band board 422 is fastened to the ends of the joists and the sill plate in a conventional manner.

The lower end (first course) of concrete wall blocks 412 rests upon the footing 414, and the concrete slab 416 seats directly against the sides of the first course of blocks 412. The second course of blocks 412 is directly above the first course, and this second course has a substantial tendency to be driven inwardly by hydrostatic pressure. Any course of blocks in the wall may move inwardly relative to the first course, and the solution for the second course may be applied to any course of blocks relative to any lower course of blocks.

Similarly to the embodiment described above in relation to FIG. 5, it is contemplated to place an aggregate composite 430 in the wall 410. In addition to the aggregate composite 430, instead of a separate strip 140 described above, it is contemplated in the embodiment of FIG. 13 to insert a strip 440 of fibers, such as fiberglass, carbon fiber or the like, which is very strong in resisting tensile deformation. The strip 440 is in contact with the inner surface of the concrete wall 410, and preferably adheres to the inwardly-facing surface of the wall 410 as described in U.S. Pat. No. 7,681,367.

One end of the strip 440 extends continuously from adhesion to the wall 410 to inside the wall voids as with the strip 140 described above. The aggregate composite 430, and particularly the adhesive therein, may infiltrate the strip 440 and the aggregate particles may protrude between at least some of the fibers in the strip 440. This combination replaces the strip 140 shown and described above with a continuous strip that both adheres to the face of the wall 410 and extends into the wall 410 and is surrounded by the aggregate composite 430. Thus, the strip 440 extends continuously from inside the wall 410, along the wall's inwardly facing surface, and may extend to attachment to a floor joist 418 adjacent the top of the wall 410, or resting upon the wall 410. The strip 440 may be placed in the voids prior to placing the composite 430 in the voids, or at least prior to the composite 430 hardening.

The strip 440, which is shown in FIG. 13, has an upwardly-extending leg 442 and an outwardly extending, horizontal leg 444. The orientation of the strip 440 is not limited by the terminology used for its components (e.g., upwardly, outwardly and horizontal), but these terms are used herein for the orientation shown in FIG. 13.

The strip 440 is preferably inserted into the blocks 412 through an opening formed in the mortar between the courses of blocks 412 between the upper and the lower of the two lowest blocks 412, but this can be between any two courses of blocks. The opening need be only slightly larger than the width and thickness of the strip 440 so that the horizontal leg 444 extends well into the opening. The strip 440 is further inserted until the upwardly-extending leg 442 is placed against the inwardly-facing surface of the wall 410 as shown in FIG. 13.

As the aggregate composite 430 is placed in the voids, the composite flows downwardly and around the strip 440 and fills the void as full as is feasible, which includes flowing between the horizontal leg 444 and the inside of the front face of the block 412. The aggregate composite thus flows into the voids around the strip 440 and adheres thereto. Thus, the space between the horizontal leg 444 and the front face of the block 412 is filled with aggregate composite 430. Similarly, the outwardly facing surface of the upwardly-extending leg 442 is adhered to the inwardly facing surface of the wall 410, and the upper end of the upwardly-extending leg 442 may be mounted to the joist 418 or some other structure at the top of the wall 410.

Figure 14:
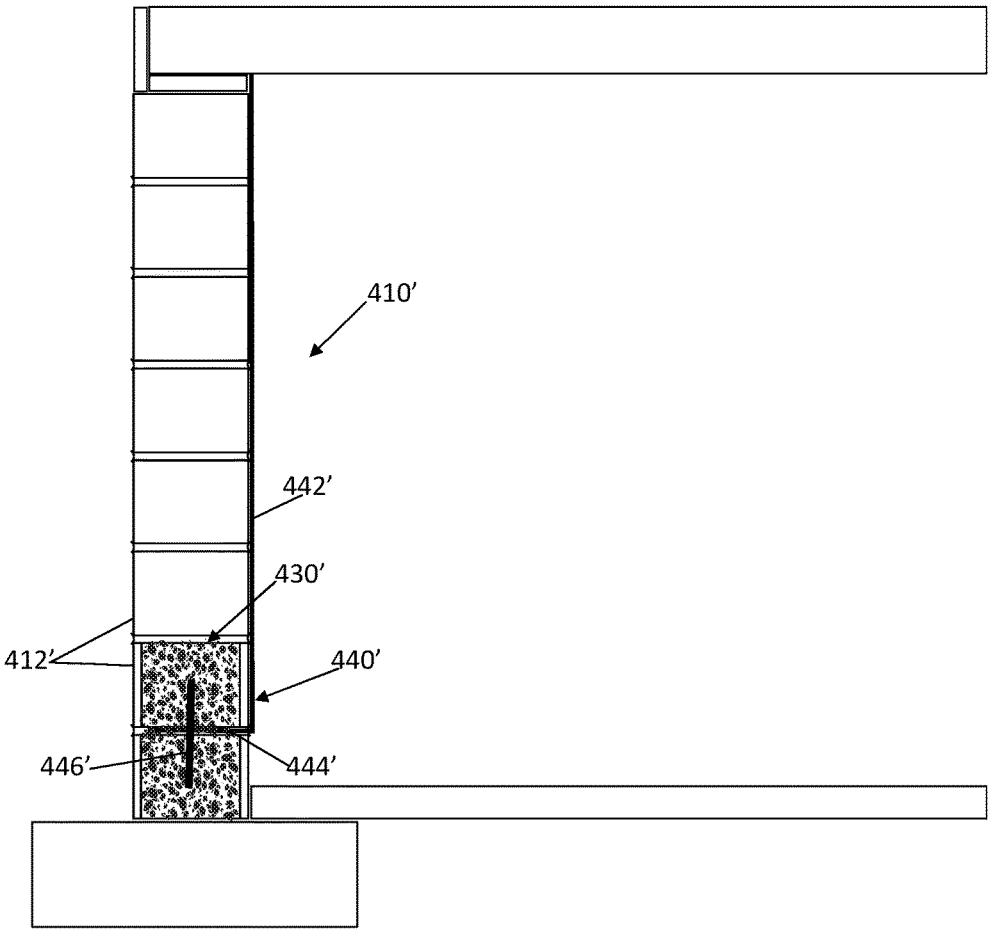
FIG. 14 is a schematic side view in section illustrating a concrete wall in combination with an embodiment of the present invention.

Upon hardening, the aggregate composite 430 forms a very strong filler of the void and immobilizes the strip 440 in the void by surrounding the strip 440 and extending to the limits of the void's defining sidewalls. Thus, any force applied to the strip 440 tending to move the strip 440 horizontally inwardly, outwardly or in any other direction, is resisted by the hardened composite 430, which is resisted by the sidewalls of the respective block(s) 412, and adhesion to the walls of the blocks 412 within the voids. In a preferred embodiment, the composite 430 fills the voids above the horizontal leg 444 of the strip 440 to about the top of the second course of blocks 412 up from the footing 414. In FIG. 14 a concrete wall 410' is formed of a plurality of concrete blocks 412', which is similar to the wall 410 described above. In the embodiment of FIG. 14, a strip 440' of fibers, such as fiberglass, carbon fiber or the like, is mounted to the inner surface of the concrete wall 410', and preferably adheres to the inwardly-facing surface of the wall 410' as described in U.S. Pat. No. 7,681,367. One end of the strip 440' extends continuously from adhesion to the wall 410' to inside the wall voids. The aggregate composite 430', and particularly the adhesive therein, may infiltrate the strip 440' and the aggregate particles may protrude between at least some of the fibers in the strip 440'. This combination thus includes a continuous strip that both adheres to the face of the wall 410' and extends into the wall 410' and is surrounded by the aggregate composite 430'. Thus, the strip 440' extends continuously from inside the wall 410', along the wall's inwardly facing surface, and may extend to attachment to a floor joist adjacent the top of the wall 410', or resting upon the wall 410'. The strip 440' may be placed in the voids prior to placing the composite 430' in the voids, or at least prior to the composite 430' hardening.

The strip 440' has an upwardly-extending leg 442' and an outwardly extending, horizontal leg 444'. In addition to the strip 440' of fibers, a rod 446' may be inserted within the aggregate composite 430' in the wall 410'. The rod 446' may be any rigid material, such as steel, aluminum, composite or any equivalent material. The rod 446' is inserted through the horizontal leg 444', such as by cutting a hole through the horizontal leg 444', by wrapping the horizontal leg 444' around the rod 446', and/or by adhering the horizontal leg 444' to the rod 446'. The orientation of the strip 440' is not limited by the terminology used for its components (e.g., upwardly, outwardly and horizontal), but these terms are used herein for the orientation shown in FIG. 14.

The strip 440' and the rod 446' are preferably inserted into the blocks 412' through an opening formed in the mortar between the courses of blocks 412' between the upper and the lower of the two lowest blocks 412', but they can be inserted between any two courses of blocks. The opening need be only slightly larger than the width and thickness of the strip 440' and the rod's 446' thickness so that both may extend into the opening. The strip 440' is further inserted until the upwardly-extending leg 442' is placed against the inwardly-facing surface of the wall 410' as shown in FIG. 14 and the rod 446' is disposed in a substantially perpendicular orientation relative to the horizontal leg 444'.

As the aggregate composite 430' is placed in the voids, the composite flows downwardly and around the strip 440' and fills the void as full as is feasible, which includes flowing between the rod 446' and the inside of the front face of the block 412'. The aggregate composite flows into the voids around the strip 440'. Thus, the space between the rod 446' and the front face of the block 412' is filled with aggregate composite 430'. Similarly, the outwardly facing surface of the upwardly-extending leg 442' is adhered to the inwardly facing surface of the wall 410', and the upper end of the upwardly-extending leg 442' may be mounted to a joist or some other structure at the top of the wall 410'.

Upon hardening, the aggregate composite 430' forms a very strong filler of the void and immobilizes the strip 440' in the void by surrounding the strip 440' and the rod 446' and extending to the limits of the void's defining sidewalls. Thus, any force applied to the strip 440' tending to move the strip 440' horizontally inwardly, outwardly or in any other direction, is resisted by the hardened composite 430', which is resisted by the sidewalls of the respective block(s) 412', and adhesion to the walls of the blocks 412' within the voids. In a preferred embodiment, the composite 430' fills the voids above the horizontal leg 444' of the strip 440' to about the top of the second course of blocks 412' up from the footing.

Figure 8:
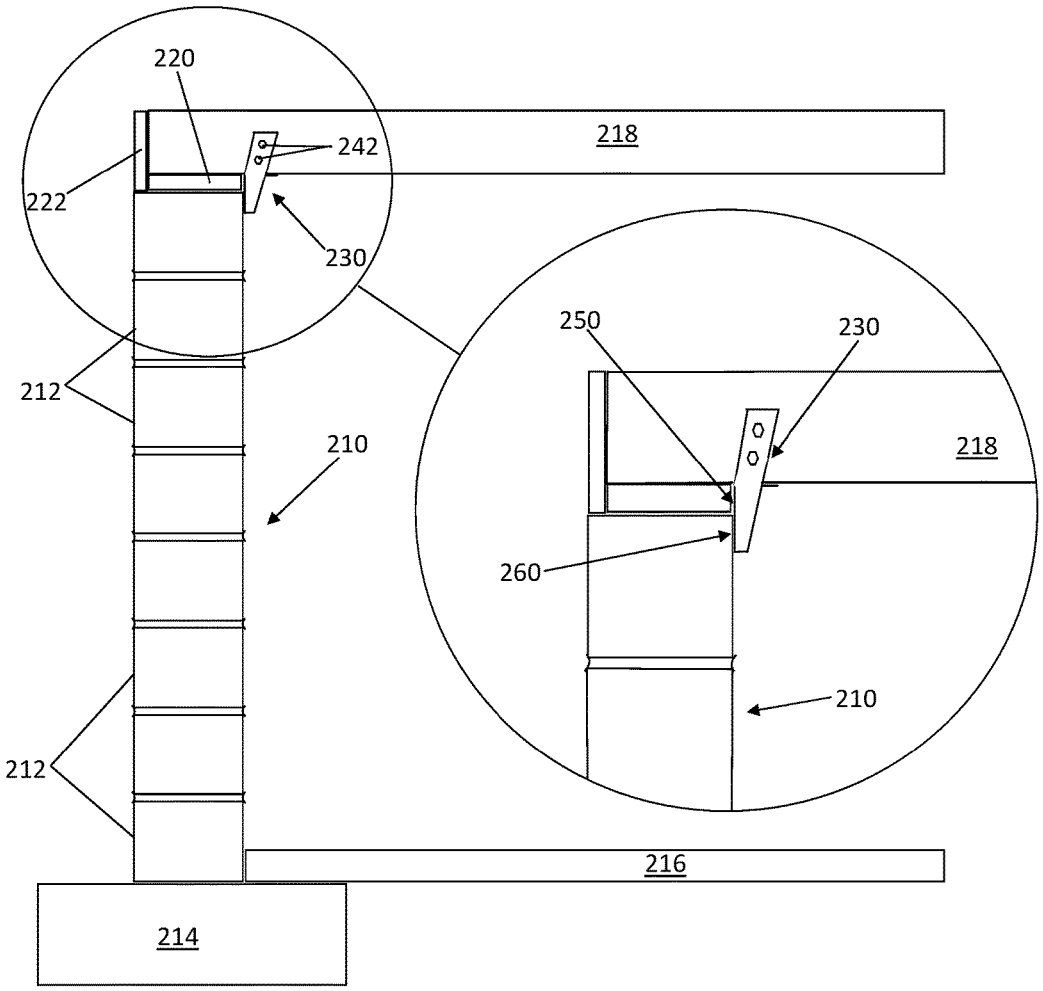
FIG. 8 is a schematic side view in section illustrating a concrete wall to which an embodiment of the present invention is mounted.

An alternative top wall support 230 is shown in FIGS. 8-11. In FIG. 8 a concrete wall 210 is formed of a plurality of concrete blocks 212 that are preferably fastened together conventionally using mortar between adjacent blocks, as with the walls 10 and 110 described above. The stack of blocks 212 rests upon a footing 214 preferably formed of hardened concrete. A slab 216, which is typically concrete poured onto a gravel bed that is placed inside the footing, rests upon the footing 214 and the gravel, and abuts the lowest block 212 at the periphery of the slab 216. A floor joist 218 rests at its outer edges on a sill plate 220 that is fastened to the top of the wall 210. A band board 222 is fastened to the ends of the joists and the sill plate.

Figure 9:
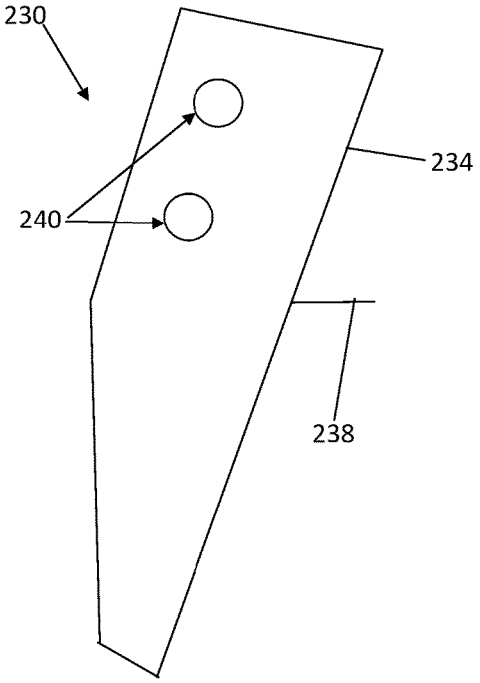
FIG. 9 is a side view illustrating an embodiment of the present invention.
Figure 10:
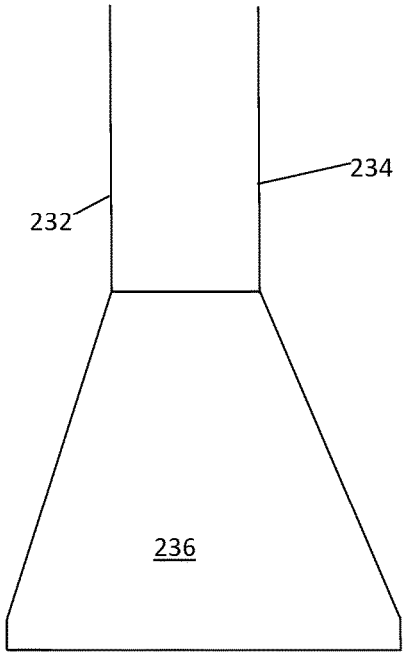
FIG. 10 is an end view illustrating the embodiment of FIG. 9.
Figure 11:
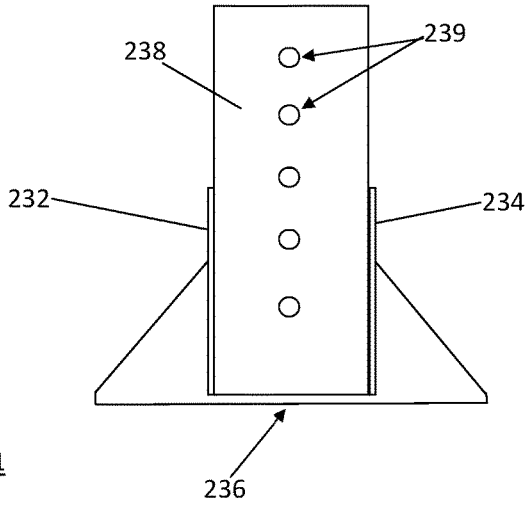
FIG. 11 is a top view illustrating the embodiment of FIG. 9.

The support 230 mounts to the joist 218 just inside of the sill plate 220 and extends downwardly to contact, or at least be in close proximity to, the inwardly-facing surface of the top block 212 in the wall 210. As shown in FIGS. 9-10 in more detail and from different perspectives, the support 230 has two legs 232 and 234 that extend from a plate 236 that seats against the wall 210. The joist-mounting plate 238 extends substantially perpendicularly away from the plate 236. One end of the joist-mounting plate 238 is positioned between the legs 232 and 234. Apertures 240 are formed in the legs 232 and 234, and apertures 239 are formed in the joist-mounting plate 238. The support 230 may be bent into the shape shown from a single plate of metal, such as steel or aluminum, or it may be molded from another strong material, such as cast iron or fiber-reinforced plastic.

In the preferred mounting location, which is shown in FIG. 8, the joist-mounting plate 238 rests against the lower edge of the joist 218, and the legs 232 and 234 extend upwardly on opposite sides of the lower edge of the joist 218. Screws, nails or any other fasteners extend through the apertures 239 formed in the joist-mounting plate 238 to fix the support to the joist 218. The aligned apertures 240 formed in each of the legs 232 and 234 preferably receive screws or the bolts 242 shown in FIG. 8 that are tightened against the legs 232 and 234, and extend through holes formed in the joist 218. The plate 236 has an upper end 250 disposed near a top of the concrete wall 210 and a lower end 260 disposed below the top of the concrete wall 210. The lower end 260 of the plate is horizontally-inwardly of, and at least in close proximity to, the interior surface of the concrete wall 210. Thus, any inwardly directed movement by the wall 210 is resisted by the abutting support 230, which transfers the inwardly-directed load to the joist 218.

An alternative embodiment of the FIG. 1 embodiment is contemplated for supporting a wall against inwardly-directed forces where the floor joists are parallel to the wall, rather than perpendicular or otherwise transverse. In such situations, there may be insufficient room to mount the support 30. The contemplated alternative is a modified version of the support 30, and is shown in an operable position in FIG. 12. Of course, the support 230 may be used in the situations when joists are parallel to the wall by simply providing blocking between the parallel joists.

Figure 12:
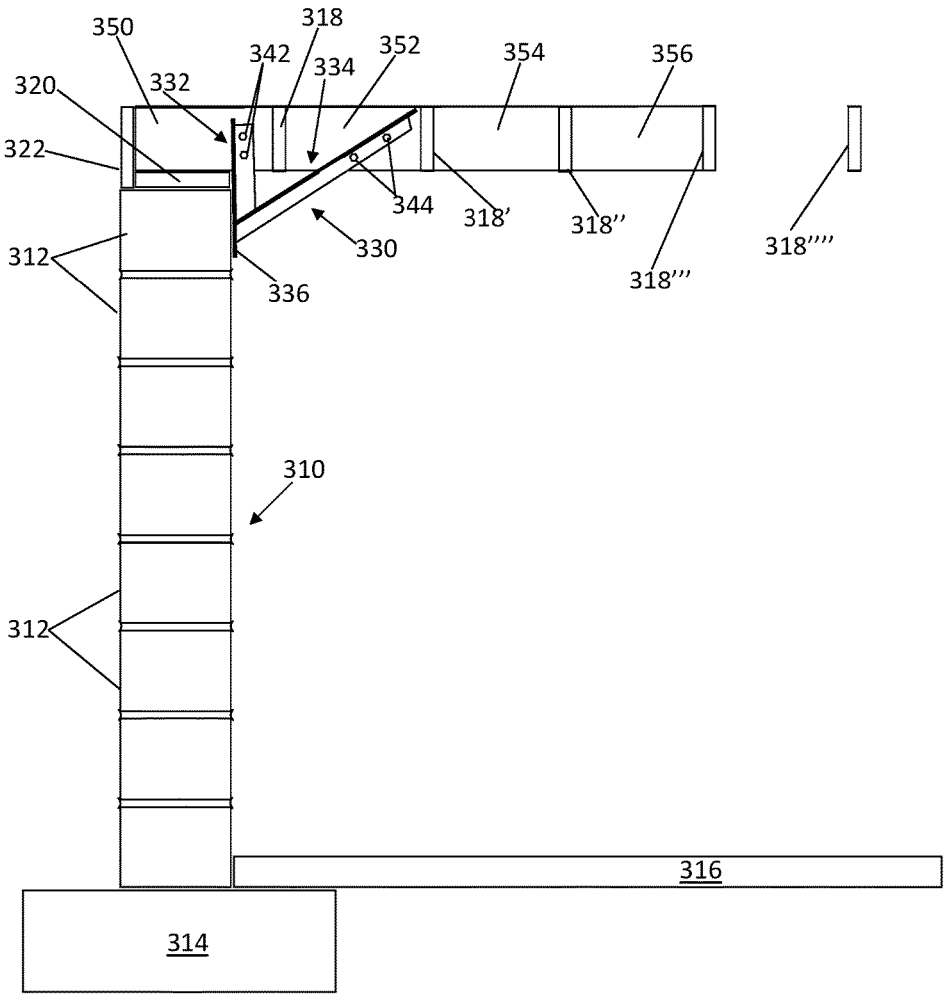
FIG. 12 is a schematic side view in section illustrating a concrete wall in combination with an embodiment of the present invention.

In FIG. 12 a concrete wall 310 is shown that is formed of a plurality of concrete blocks 312 that are preferably fastened together with conventional mortar between adjacent blocks. The stack of blocks 312 rests upon a footing 314, which is conventional for buildings in order to provide a stable foundation on which to support the weight of the building. The footing 314 is preferably formed conventionally of hardened concrete that was poured in a semi-liquid state into a trench dug around the base of the building site. A slab 316, which is conventionally made of concrete that was poured in a semi-liquid state onto a gravel bed placed inside the footing. The slab 316 rests upon the footing 314 and the gravel, and abuts the lowest block 312 at the periphery of the slab 316. A conventional floor joist 318 rests at its outer edges on a conventional sill plate 320 that is fastened to the top of the wall 310 in a conventional manner. A band board 322 is fastened to the ends of the joist 318, the parallel joists, and the sill plate in a conventional manner.

As shown in FIG. 12, a support bracket 330 is mounted to joist blockings 350 and 352 between the band board 322 and the joist 318, and between the joists 318 and 318'. Further blocking may be mounted in the spaces between the joists 318', 318" and 318". The support 330 is similar to the support 30 shown in more detail in FIG. 2, and may be similarly made of steel, aluminum, titanium, fiber-reinforced plastic or any other strong material. The support 330 has an outer leg 332 and an inner leg 334, which form two legs of a generally V-shaped structure. A plate 336 extends downwardly (in the orientation shown in FIG. 12) from the intersection of the inner and outer legs, and the legs attach to the upper end of the plate 336. The inner leg 334 has a web that extends downwardly in the FIG. 12 orientation, and the outer leg 332 has a web that extends upwardly in the FIG. 12 orientation. Apertures are formed through the webs through which bolts or screws may be extended into the blocking 350 and 352. The legs 332 and 334 have an angle between them of about 60 degrees.

The support 330 is shown in FIG. 12 firmly mounted to the blockings 350 and 352, which are preferably securely mounted to the band board 322 and the joists 318 and 318'. The plate 336 extends downwardly to below the sill plate 320 and the plate 336 is disposed horizontally inwardly from the top edge of the concrete wall 310. The plate 336 preferably touches the inner surface of the wall 310. If the plate 336 is not in contact with the wall 310, it is at least in close proximity to the wall. In a preferred embodiment, the plate 336 extends downwardly one to three inches below the top edge of the wall 310, but it is sufficient for the plate 336 to extend about one inch below the top edge of the wall 310.

When in an operable position shown in FIG. 12, the legs 332 and 334 function as the legs 32 and 34 of the support 30, but because of the slightly different orientation of the legs 332 and 334, the support 330 is able to extend beneath the joist 318. Because the blockings 350-356 transfer the load from the wall 310 to the flooring system of the building, which then transfers the load to the opposite concrete wall, and, thereby, the foundation of the building, it is clear that the support 330 operates substantially the same as the support 30 described above. The blocking extends only between some joists, but blocking could extend from one side of the building to the opposite side, if necessary or desired. The support 230 may be mounted in place of the support 330. It is to be understood that the blocking or other similar structures placed between joists that are parallel to the wall being supported are considered "joists" for the purpose of understanding the invention. That is, the blocking or other structures that connect together the flooring structure is to be understood to fall within the meaning of the term "joist" when understanding the claims.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A wall support system that transfers mechanical loads, caused by hydrostatic forces on an exterior surface of a concrete wall that is made up of at least a first and second course of blocks with multiple voids that extend vertically therein, to a floor joist that is at least partially vertically supported by the concrete wall, the wall support system comprising:

(a) a plate extending substantially vertically along an interior surface of the concrete wall that opposes the exterior surface, the plate having an upper end disposed near a top of the concrete wall and a lower end disposed below the top of the concrete wall, wherein the lower end of the plate is horizontally-inwardly of, and at least in close proximity to, the interior surface of the concrete wall;

(b) a first leg mounted to the plate and extending along, and attached to, an underside of the joist;

(c) a second leg mounted to a first side of the floor joist, the second leg having a first end mounted to the upper end of the plate and a second, opposite end disposed above the plate;

(d) a third leg mounted to the floor joist on a second, opposite side of the floor joist from the second leg, the third leg having a first end mounted to the upper end of the plate and a second, opposite end disposed above the plate, wherein a fastener extends through the floor joist and the second and third legs; and (e) a support comprising a highly water-permeable aggregate composite formed within at least a plurality of the voids of the first and second courses of blocks, the aggregate composite including particulate combined with sufficient adhesive to coat the particulate and cause each of the particulate to bond at contacting points with other of the particulate leaving spaces between adjacent particulate for water to flow therethrough.

2. The wall support system in accordance with claim 1, further comprising a strip surrounded on at least a first end by the aggregate composite and extending to a second end of the strip that seats against the interior surface of the concrete wall.

3. The wall support system in accordance with claim 1, further comprising a strip surrounded on at least a first end by the aggregate composite and extending out of the concrete wall to a second end of the strip at the interior surface of the concrete wall.

4. The wall support system in accordance with claim 3, wherein the second end of the strip seats against the interior surface of the concrete wall.

5. The wall support system in accordance with claim 3, wherein the second end of the strip is adhered to the interior surface of the concrete wall.

* * * * *